US010624804B2

(12) United States Patent
Williams et al.

(10) Patent No.: US 10,624,804 B2
(45) Date of Patent: Apr. 21, 2020

(54) MICROCLIMATE MANAGEMENT AIRFLOW CONTROL BASED ON INCONTINENCE DETECTION

(71) Applicant: Hill-Rom Services, Inc., Batesville, IN (US)

(72) Inventors: Joshua A Williams, West Harrison, IN (US); Charles A Lachenbruch, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 567 days.

(21) Appl. No.: 15/231,919

(22) Filed: Aug. 9, 2016

(65) Prior Publication Data

US 2017/0049645 A1 Feb. 23, 2017

Related U.S. Application Data

(60) Provisional application No. 62/206,484, filed on Aug. 18, 2015, provisional application No. 62/277,596, filed on Jan. 12, 2016.

(51) Int. Cl.

| | |
|---|---|
| ***A61G 7/05*** | (2006.01) |
| ***A61G 7/02*** | (2006.01) |
| ***A61G 7/057*** | (2006.01) |

(52) U.S. Cl.

CPC ..... *A61G 7/05* (2013.01); *A61G 7/02* (2013.01); *A61G 7/05784* (2016.11); (Continued)

(58) Field of Classification Search

CPC ..... A61F 13/15; A61G 7/05; A61G 7/05784; A61G 7/02; A61G 2203/30

See application file for complete search history.

(56) References Cited

U.S. PATENT DOCUMENTS

| | | | |
|---|---|---|---|
| 1,772,232 | A | 8/1930 | Van Guilder |
| 1,772,310 | A | 8/1930 | Hart |

(Continued)

FOREIGN PATENT DOCUMENTS

| | | | |
|---|---|---|---|
| FR | 2 041 672 | A5 | 1/1971 |
| GB | 2145859 | A | 4/1985 |

(Continued)

OTHER PUBLICATIONS

European Search Report for EP16184161.4 dated May 12, 2016, 6 pages.

(Continued)

*Primary Examiner* — Eric J Kurilla
*Assistant Examiner* — Alexis Felix Lopez
(74) *Attorney, Agent, or Firm* — Barnes & Thornburg LLP

(57) ABSTRACT

A microclimate system includes an air box, a disposable incontinence pad, and a mattress. The incontinence pad serves as an incontinent event detector. The disposable incontinence pad may be configured to conduct air along an interface of the disposable incontinence pad to withdraw heat and moisture from a patient and cools and dries the patient's skin in order to reduce the risk of bed sore formation. The mattress may include a microclimate management layer that provides conditioned air to withdraw heat and moisture from the disposable incontinence pad thereby keeping the patient's skin cool and dry in order to reduce the risk of bed sore formation.

17 Claims, 6 Drawing Sheets

(52) U.S. Cl.
CPC ..... *A61G 2203/30* (2013.01); *A61G 2210/70* (2013.01); *A61G 2210/90* (2013.01)

(56) References Cited

U.S. PATENT DOCUMENTS 2,127,538 A 8/1938 Seiger
2,644,050 A 6/1953 Seiger
2,668,202 A 2/1954 Kaplan
2,726,294 A 12/1955 Kroening et al.
2,907,841 A 10/1959 Campbell
3,199,095 A 8/1965 Hiroo
3,759,246 A 9/1973 Flack et al.
3,971,371 A 7/1976 Bloom
4,069,817 A 1/1978 Fenole et al.
4,106,001 A 8/1978 Mahoney
4,163,449 A 8/1979 Regal
4,191,950 A 3/1980 Levin et al.
4,212,295 A 7/1980 Snyder
4,228,426 A 10/1980 Roberts
4,347,503 A 8/1982 Uyehara
4,539,559 A 9/1985 Kelly et al.
4,593,275 A 6/1986 Kazandjoglou
4,745,647 A 5/1988 Goodwin
4,761,638 A 8/1988 Lozano
4,947,500 A 8/1990 Seiler
4,965,554 A 10/1990 Darling et al.
4,989,283 A 2/1991 Krouskop et al.
5,081,422 A 1/1992 Shih et al.
5,086,291 A 2/1992 Schwab
5,137,033 A 8/1992 Norton
5,144,284 A 9/1992 Hammett
5,170,364 A 12/1992 Gross et al.
5,192,932 A * 3/1993 Schwab, Jr. ..... A61F 5/48 324/693
5,249,319 A 10/1993 Higgs
5,283,735 A 2/1994 Gross et al.
5,291,181 A 3/1994 DePonte
5,537,095 A 7/1996 Dick et al.
5,560,374 A 10/1996 Viard et al.
5,760,694 A 6/1998 Nissim et al.
5,787,523 A 8/1998 Lindberg
5,815,864 A 10/1998 Sloop
5,824,883 A 10/1998 Park et al.
5,947,943 A 9/1999 Lee
6,079,068 A 6/2000 Viard et al.
6,223,369 B1 5/2001 Maier et al.
6,341,393 B1 1/2002 Votel
6,385,803 B1 5/2002 Viard
6,493,568 B1 12/2002 Bell et al.
6,583,722 B2 6/2003 Jeutter et al.
6,603,403 B2 8/2003 Jeutter et al.
6,623,080 B2 9/2003 Clapper
6,943,694 B1 9/2005 Ellis
7,071,830 B2 7/2006 Sahlberg et al.
7,355,090 B2 4/2008 Ales, III et al.
7,489,252 B2 2/2009 Long et al.
7,498,478 B2 3/2009 Long et al.
7,595,734 B2 9/2009 Long et al.
7,649,125 B2 1/2010 Ales, III et al.
7,834,234 B2 11/2010 Roe et al.
7,834,235 B2 11/2010 Long et al.
7,838,720 B2 11/2010 Roe et al.
7,849,544 B2 12/2010 Flocard et al.
7,914,611 B2 3/2011 Vrzalik et al.
7,937,789 B2 5/2011 Feher
7,977,529 B2 7/2011 Bergman et al.
8,104,126 B2 1/2012 Caminade et al.
8,121,856 B2 2/2012 Huster et al.
8,482,305 B2 7/2013 Johnson
8,487,774 B2 7/2013 Reeder et al.
8,598,893 B2 12/2013 Camus
8,745,797 B2 6/2014 Misaki et al.
8,766,804 B2 7/2014 Reeder et al.
8,868,244 B2 10/2014 Genaro
8,878,557 B2 11/2014 Kristiansen et al.
8,959,685 B2 2/2015 Misaki et al.
9,009,892 B2 4/2015 Lachenbruch et al.
9,021,638 B2 5/2015 Misaki
9,138,064 B2 9/2015 Tursi, Jr. et al.
9,230,421 B2 1/2016 Reeder et al.
9,322,797 B1 4/2016 Lastinger et al.
9,366,644 B1 6/2016 Lastinger et al.
9,392,875 B2 7/2016 Weyl
9,408,757 B2 8/2016 Elfstrom et al.
9,506,886 B1 11/2016 Woodbury et al.
2003/0030319 A1 2/2003 Clapper
2003/0181090 A1 9/2003 Ehr et al.
2004/0178807 A1 9/2004 Sahlberg et al.
2005/0055768 A1 3/2005 Assink
2005/0099294 A1 5/2005 Bogner et al.
2006/0229577 A1 10/2006 Roe et al.
2006/0229578 A1 10/2006 Roe et al.
2007/0004971 A1 1/2007 Riley et al.
2007/0010719 A1 1/2007 Huster et al.
2007/0049881 A1 3/2007 Ales et al.
2007/0049882 A1 3/2007 Long et al.
2007/0049883 A1 3/2007 Ales et al.
2007/0118993 A1 5/2007 Bates
2007/0204691 A1 9/2007 Bogner et al.
2007/0252710 A1 11/2007 Long et al.
2007/0252711 A1 11/2007 Long et al.
2007/0261548 A1 11/2007 Vrzalik et al.
2007/0270774 A1 11/2007 Bergman et al.
2008/0058745 A1 3/2008 Long et al.
2010/0011502 A1* 1/2010 Brykalski ..... A47C 21/044 5/423
2010/0011839 A1 1/2010 Browning
2010/0274331 A1* 10/2010 Williamson ..... A61G 7/05738 607/104
2010/0308846 A1 12/2010 Camus
2011/0092890 A1* 4/2011 Stryker ..... A47C 21/00 604/23
2011/0185509 A1 8/2011 Genaro
2011/0193703 A1 8/2011 Payton et al.
2011/0218684 A1 9/2011 Genaro
2011/0308020 A1 12/2011 Vrzalik et al.
2012/0038374 A1 2/2012 Johnson
2013/0104312 A1 5/2013 O'Reagan
2013/0263379 A1 10/2013 Misaki et al.
2014/0013514 A1 1/2014 Misaki
2014/0013515 A1 1/2014 Richards et al.
2014/0101862 A1 4/2014 Misaki
2014/0130264 A1 5/2014 Misaki et al.
2016/0143572 A1 5/2016 Susnjar

FOREIGN PATENT DOCUMENTS

WO 2006110428 A1 10/2006
WO 2006110502 A1 10/2006
WO 2008115987 A2 9/2008
WO 2010043368 A1 4/2010
WO 2012084987 A2 9/2012
WO 2014/036472 A1 3/2014

OTHER PUBLICATIONS

European Search Report from EP 16184161.4 dated Feb. 27, 2018, 3 pages.
European Search Report from EP 16 18 4161 dated Dec. 5, 2016, 8 pages.
European Search Report for EP19159809.3 dated May 29, 2019, 5 pages.

* cited by examiner

MICROCLIMATE MANAGEMENT AIRFLOW CONTROL BASED ON INCONTINENCE DETECTION

CROSS-REFERENCE TO RELATED APPLICATIONS

The present application claims the benefit, under 35 U.S.C. § 119(e), of U.S. Provisional Application Nos. 62/206,484, filed Aug. 18, 2015, and 62/277,596, filed Jan. 12, 2016, both of which are hereby incorporated by reference herein.

BACKGROUND

The present disclosure relates to bed mattresses for supporting patients and to incontinence pads that sense patient incontinence. More specifically, the present disclosure relates to disposable incontinence pads of hospital beds, medical beds, or other types of beds in which the disposable incontinence pads are designed to absorb liquid in case of incontinent events.

In a care facility, such as a hospital or a nursing home, patients are often placed on patient support apparatuses for an extended period of time. Some patients who are positioned on the patient support apparatuses may have a risk of developing certain skin conditions, such as bed sores (also known as pressure sores or decubitus ulcers), due to heat and moisture present at the interface of the patient and the surface of a bed mattress. In an effort to mitigate or prevent such conditions, some bed mattresses have a built-in microclimate structure. While various microclimate management systems have been developed, in certain applications there is still room for improvement. Thus, a need persists for further contributions in this area of technology.

SUMMARY

The present application discloses one or more of the features recited in the appended claims and/or the following features which, alone or in any combination, may comprise patentable subject matter:

According to one aspect of the present disclosure, a patient support structure comprises a mattress, a microclimate system, and a disposable incontinence pad. The mattress further includes a mattress inlet port and a mattress outlet port. The microclimate system further includes an air box and a controller, where the air box is coupled to the controller and is also coupled to the mattress. The disposable incontinence pad atop the mattress and comprises an upper layer, a lower layer, and a middle layer. The upper layer is vapor and liquid permeable, the lower layer is liquid impermeable, and the middle layer is air permeable. The middle layer further includes a pad inlet port and a side vent at the opposite side of the pad inlet port. The air box is coupled to the mattress, and the mattress outlet port is coupled to the pad inlet port of the disposable incontinence pad to conduct air.

In some embodiments, the air box is further coupled to the mattress via a conduit. The conduit is configured to conduct the air from the air box to the mattress.

In some embodiments, the mattress inlet port is coupled to the air box, and the mattress outlet port is coupled to the disposable incontinence pad.

In some embodiments, the disposable incontinence pad comprises a disposable material.

In some embodiments, the disposable incontinence pad is movable along a top surface of the mattress to underlie where the pelvic region of a patient lying supine on the patient support structure.

In some embodiments, the mattress includes inflatable support bladders.

In some embodiments, the middle layer of the disposable incontinence pad comprises a three-dimensional material configured to conduct air between the upper layer and the lower layer of the disposable incontinence pad.

In some embodiments, a conduit connecting the pad inlet and the mattress outlet port further includes a check valve to prevent moisture and liquid from overflowing into the conduit while providing the air to the disposable incontinence pad.

In some embodiments, the controller of the microclimate system further detects the liquid level of the middle layer of the disposable incontinence pad.

In some embodiments, the controller automatically shuts off the air from the air box when the liquid level exceeds a predetermined threshold level to prevent liquid from overflowing into the air box.

In some embodiments, the controller activates an indicator to alert caretakers when the liquid level exceeds a predetermined threshold level.

In a second aspect of the present disclosure, a patient support structure comprises a microclimate system and a disposable incontinence pad. The microclimate system further includes an air box and a controller, where the air box is coupled to the controller. The disposable incontinence pad atop the mattress and comprises an upper layer, a lower layer, and a middle layer. The upper layer is vapor and liquid permeable, the lower layer is liquid impermeable, and the middle layer is air permeable. The middle layer further includes a pad inlet port and a side vent at the opposite side of the pad inlet port.

In some embodiments, the air box is directly coupled to the pad inlet port of the disposable incontinence pad via a conduit. The conduit is configured to conduct the pressurized air from the air box to the mattress.

In some embodiments, the disposable incontinence pad is movable along a top surface of the mattress to underlie where the pelvic region of a patient lying supine on the patient support structure.

In some embodiments, the middle layer of the disposable incontinence pad comprises a three-dimensional material configured to conduct air between the upper layer and the lower layer of the disposable incontinence pad.

In some embodiments, the conduit further includes a check valve to prevent moisture and liquid from overflowing into the conduit while providing the air to the disposable incontinence pad.

In some embodiments, the controller of the microclimate system further detects the liquid level of the middle layer of the disposable incontinence pad.

In some embodiments, the controller automatically shuts off the air from the air box when the liquid level exceeds a predetermined threshold level to prevent liquid from overflowing into the air box.

In some embodiments, the controller activates an indicator to alert caretakers when the liquid level exceeds a predetermined threshold level.

In a third aspect of the present disclosure, a patient support structure comprising a disposable incontinence pad, a source of pressurized air, a conduit, and a microclimate system. The disposable incontinence pad further comprises an upper layer, a lower layer, and a middle layer. The upper layer is vapor and liquid permeable, the lower layer is liquid impermeable, and the middle layer is air permeable. The conduit is configured to conduct the pressurized air through the middle layer of the disposable incontinence pad. The microclimate system further includes an air box and a controller. The controller is configured to detect the liquid level of the disposable incontinence pad. The controller automatically shuts off the airflow when a predetermined threshold level is reached to prevent liquid from overflowing into the air box.

In a fourth aspect of the present disclosure, a patient support structure comprising a mattress having a microclimate management layer, a disposable incontinence pad, and a microclimate system including an air box, a controller, and a sensor. The disposable incontinence pad is configured to be positioned between the microclimate management layer of the mattress and a patient. The air box is coupled to the controller and the microclimate management layer of the mattress. The sensor is configured to determine a condition of the disposable incontinence pad and transmit information regarding the condition of the disposable incontinence pad to the controller.

In some embodiments, the sensor is configured to determine a condition of the disposable incontinence pad by detecting a presence of liquid in the disposable incontinence pad.

In some embodiments, the sensor is configured to communicate with the controller via a wireless network.

In some embodiments, the sensor is configured to directly communicate with the controller via a wired connection.

In some embodiments, the controller is configured to adjust the air box to provide a lower airflow in response to receiving a signal from the sensor indicating that the disposable incontinence pad is dry.

In some embodiments, the controller is configured to increase a flow rate of air from the air box in response to receiving a signal from the sensor indicating that the disposable incontinence pad is wet.

In some embodiments, the controller is configured to increase a temperature of air from the air box in response to receiving a signal from the sensor indicating that the disposable incontinence pad is wet.

In some embodiments, the controller is configured to adjust the air box to provide airflow to the microclimate management layer at a first flow rate if incontinence pad is dry. The controller is configured to provide airflow to the microclimate management layer at a second flow rate, greater than the first flow rate, if the disposable incontinence pad is wet.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
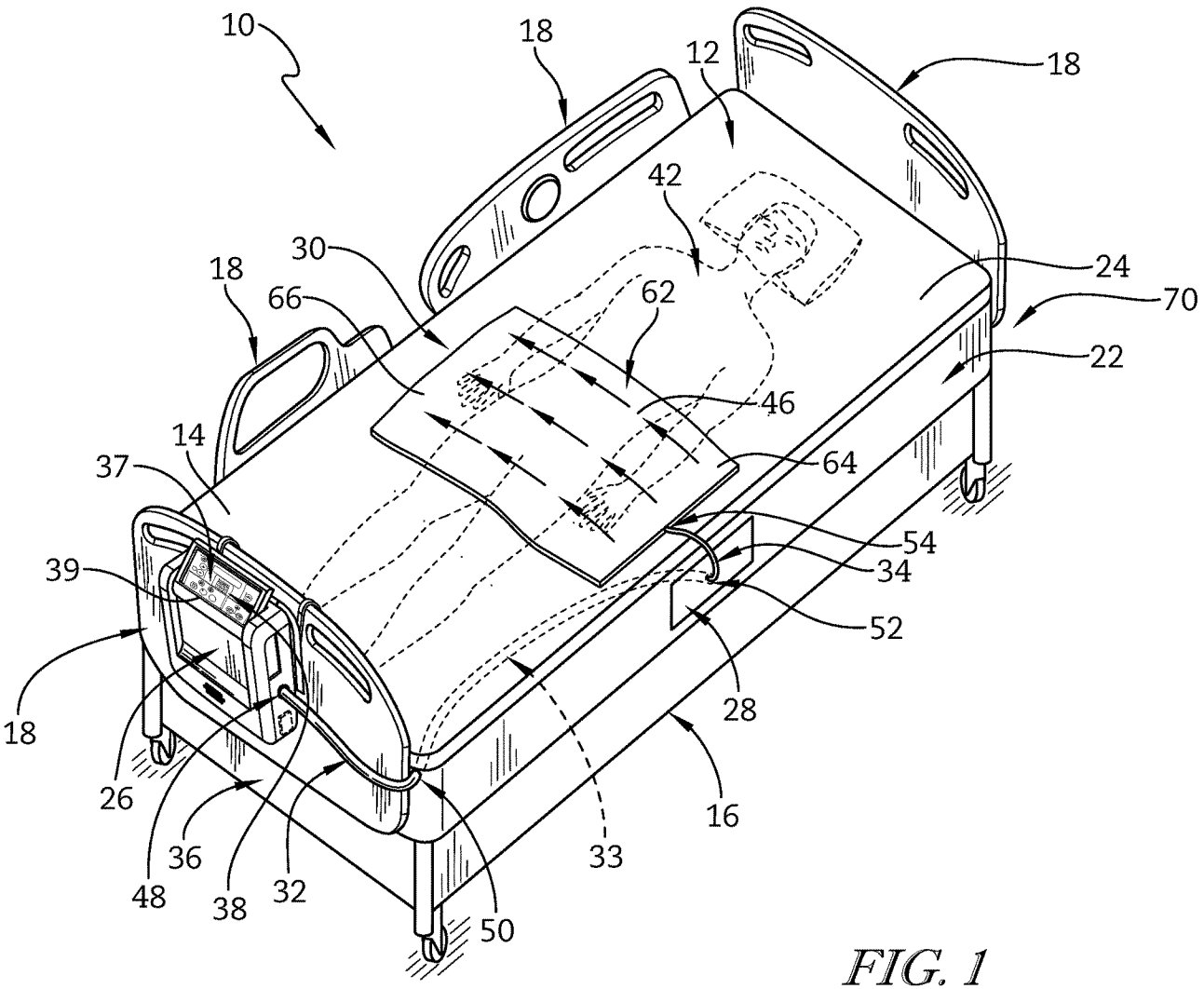
FIG. 1 is a perspective view from a foot end on a patient's left of a first embodiment of a patient support structure with a disposable incontinence pad atop a mattress, and an air box indirectly coupled to the disposable incontinence pad through a mattress.

An illustrative patient support apparatus 10 embodied as a hospital bed is shown in FIG. 1. The patient support apparatus 10 includes a frame 16, a patient support structure 70 supported on the frame 16, a microclimate system 36, and an air box 26. The patient support structure 70 is adapted to support a patient 42 lying on the patient support apparatus 10. The patient support structure 70 further includes a disposable incontinence pad 30 and a mattress 22 which supports the disposable incontinence pad 30. The mattress 22 includes a plurality of inflatable support bladders 40 (see FIG. 7). In some embodiments, the mattress 22 may include foam paddings instead of the inflatable support bladders 40. The microclimate system 36 has a user interface 38 that is configured to receive user inputs. The user interface 38 includes a display screen 37 and a plurality of buttons 39 for inputting patient information and for controlling operation of the air box 26 and the support surface 24. Particularly, the user interface 38 allows a user to adjust the flow of air provided by the air box 26 to the disposable incontinence pad 30 and to adjust the temperature of air provided by the air box 26 to the disposable incontinence pad 30. Specifically, in some embodiments, the user interface 38 may include a patient information input panel, an alarm panel, a lateral rotation therapy panel, an inflation mode panel, a normal inflation control panel, and a microclimate control panel. Accordingly, the user inputs are used to control the microclimate system 36 to cool and dry the interface between the patient 42 and the disposable incontinence pad 30 to promote skin health by removing patient heat, moisture, and liquid along the interface when the patient 42 is supported on the patient support apparatus 10.

Figure 2:
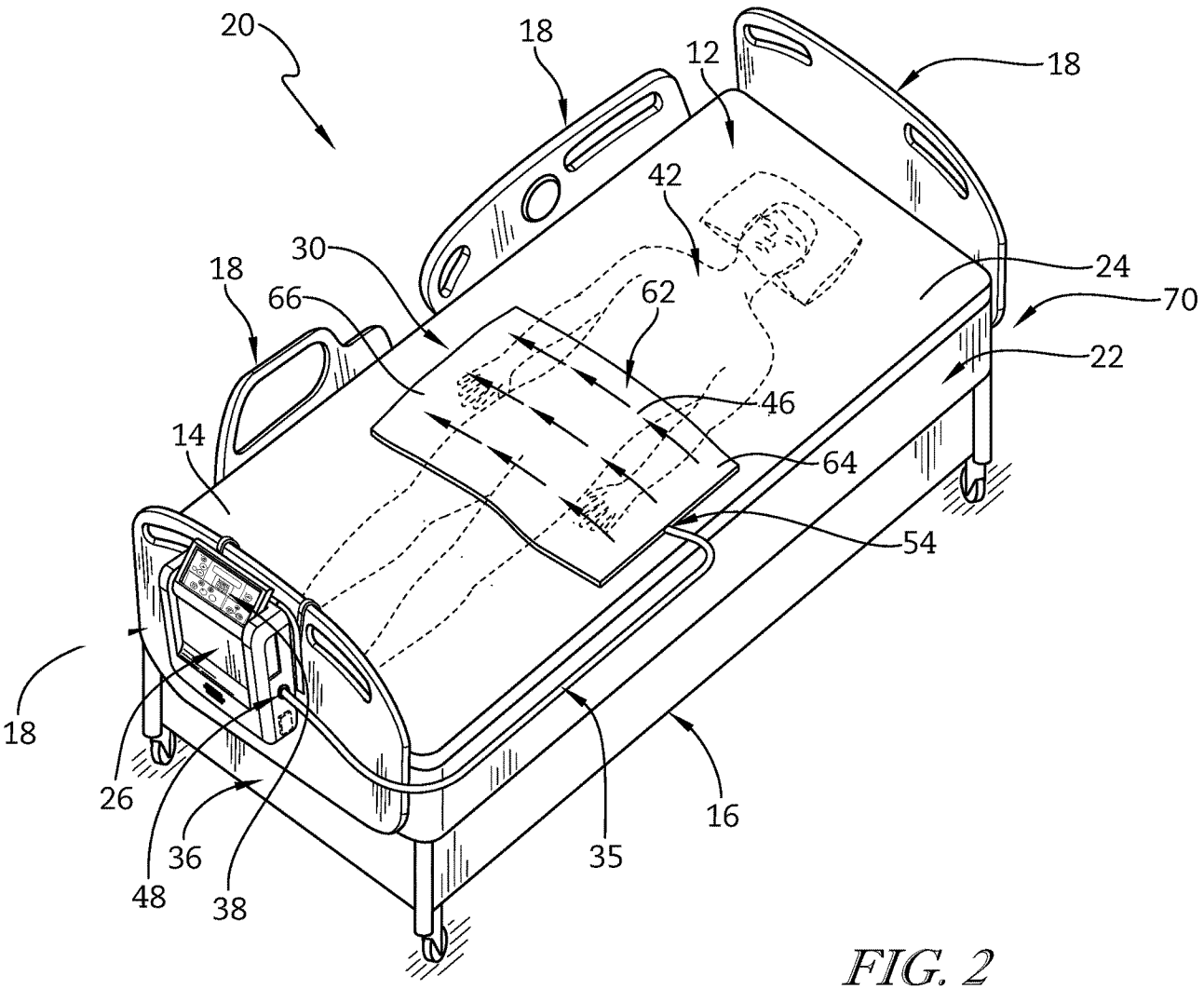
FIG. 2 is a perspective view from the foot end on the patient's left of a second embodiment of the patient support structure with the disposable incontinence pad atop the mattress, and the air box is directly coupled to the disposable incontinence pad.
Figure 3:
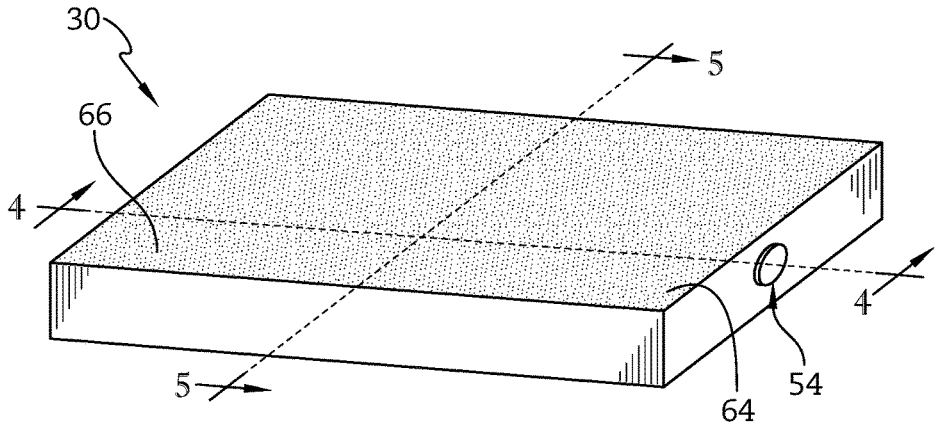
FIG. 3 is a perspective view of the disposable incontinence pad showing a microclimate inlet port.
Figure 4:
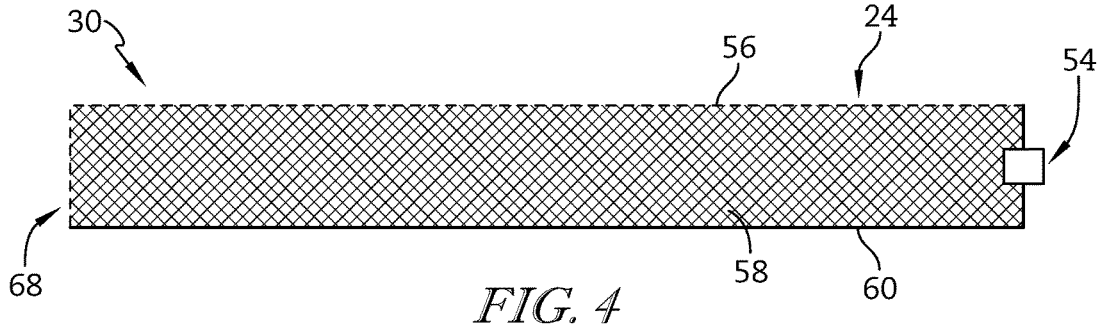
FIG. 4 is a cross section taken along section lines 4-4 of FIG. 3 showing three layers of the disposable incontinence pad, the microclimate inlet port, and a side vent.
Figure 5:
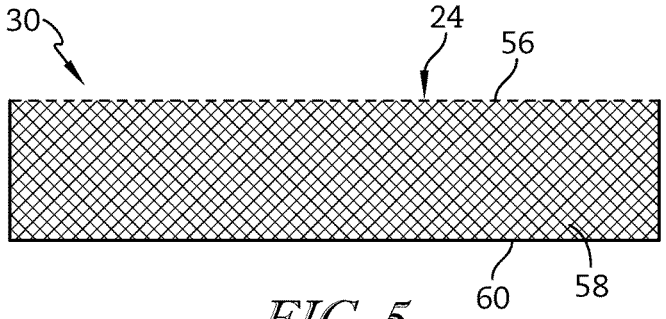
FIG. 5 is a cross section taken along lines 5-5 of FIG. 3 showing the three layers of the disposable incontinence pad.
Figure 6:
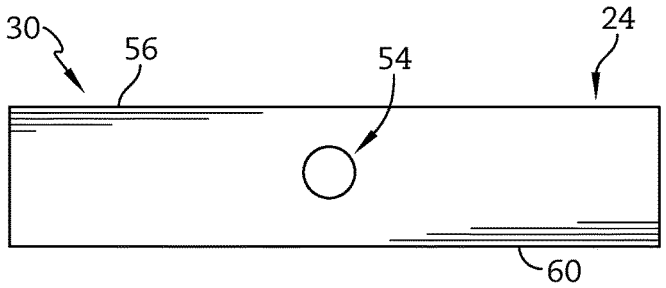
FIG. 6 is a side view taken from a patient's left side showing the microclimate inlet port of the disposable incontinence pad.

As shown in FIGS. 1 and 2, the disposable incontinence pad 30 is positioned between the patient 42 supported on the patient support apparatus 10 and an occupant side or support surface 24 of the mattress 22. The disposable incontinence pad 30 is configured to conduct air along an interface between a top surface 46 of the disposable incontinence pad 30 and the patient 42 to cool and dry the patient's skin. Particularly, the disposable incontinence pad 30 is designed to underlie the patient's pelvic region where a local climate control is mostly needed. Having the disposable incontinence pad 30 positioned at the patient's pelvic region will further allow the disposable incontinence pad 30 to absorb any liquid in case of an incontinent event. Because each patient 42 has a different body shape and size, the disposable incontinence pad 30 is movable along the support surface 24 of the mattress 22 to provide an effective climate control and absorption tailored to an individual patient 42 supported on the patient support apparatus 10.

In the illustrative embodiment, the disposable incontinence pad 30 is indirectly coupled to the air box 26 of the microclimate system 36 through the mattress 22, as shown in FIG. 1. In such embodiment, the mattress 22 includes a mattress inlet port 50 at a foot end 14 of the mattress 22 and a side panel 28 at the side of the mattress 22 which has a mattress outlet port 52. A box outlet port 48 of the air box 26 is connected to the mattress inlet port 50 of the mattress 22 by a first conduit 32. Inside of the mattress 22, the mattress inlet port 50 is connected to the mattress outlet port 52 by a second conduit 33. Lastly, the mattress outlet port 52 is connected to a microclimate inlet port 54 of the disposable incontinence pad 30 by a third conduit 34. The microclimate inlet port 54 is mounted on one side of the disposable incontinence pad 30 and is in communication with the disposable incontinence pad 30, as will described in more detail below. Accordingly, the air from the air box 26 exits the air box 26 at the box outlet port 48 and is directed to the mattress inlet port 50 of the mattress 22 via the first conduit 32. The air flows through the mattress 22 via the second conduit 33 and exits the mattress 22 at the mattress outlet port 52. The air then flows into the disposable incontinence pad 30 via the third conduit 34 and exits the disposable incontinence pad 30 through a side vent 68 located at the opposite side of the microclimate inlet port 54. In other embodiments, the vent may be located in other positions on the pad.

In other embodiments, the air box 26 may be directly coupled to the disposable incontinence pad 30 via only one conduit 35 without having to flow through the mattress 22, as shown in FIG. 2. Accordingly, the conduit 35 connects the box outlet port 48 directly to the microclimate inlet port 54, thereby allowing the air from the air box 26 to directly flow into the disposable incontinence pad 30.

Referring to FIGS. 3-6, the disposable incontinence pad 30 includes an upper layer 56, a middle layer 58, and a lower layer 60. In the illustrative embodiment, the upper layer 56 is liquid permeable, the middle layer 58 is air permeable, and the lower layer 60 is liquid impermeable. Generally, the pressurized air from the air box 26 enters the middle layer 58 of the disposable incontinence pad 30 and is pushed through the upper layer 56 so that moisture is carried away by evaporation from the top surface 46 of the upper layer 56. However, if the patient secrets body exudates faster than the rate of which the moisture from the top surface 46 of the upper layer 56 can evaporate, the patient moisture may transfer into the middle layer 58.

Illustratively, the upper layer 56 includes urethane coated nylon weave cover in which the pin-hole perforations are formed; however, in some embodiments, the holes may be larger and/or distributed over a different sized area. The pin-hole sized perforations of the upper layer 56 allow air to be pushed through the top surface 46 while preventing a large volume of air loss at the same time. The upper layer 56 further permits the transmission of any patient moisture or liquid, such as sweat, or urine in the case of an incontinent event to the middle layer 58. In some embodiments, the pin-hole perforations are omitted from the upper layer 56 and all of the air forced into the incontinence pad 30 is pushed out of the side vent 68, or any other vent which may be formed in the incontinence pad 30 in other embodiments. In still other embodiments, the side vent 68 may be omitted and all of the air may be forced through the upper layer 56.

The middle layer 58 includes the microclimate inlet port 54 on a patient's left side 64 of the disposable incontinence pad 30 and the side vent 68 on a patient's right side 66 of the disposable incontinence pad 30. The middle layer 58 further comprises a three-dimensional material between the microclimate inlet port 54 and the side vent 68. The three-dimensional material is air permeable and allows air from the air box 26 to flow along the middle layer 58 from the microclimate inlet port 54 to the side vent 68, as indicated by arrows 62 in FIGS. 1 and 2. The side vent 68 is defined by the three-dimensional material exposed on the patient's right side 66 of the middle layer 58 of the disposable incontinence pad 30. This allows air and moisture to exit the disposable incontinence pad 30. Other than the side vent 68 surface of the middle layer 58 of the disposable incontinence pad 30, the side surfaces of the middle layer 58 are coated with a moisture, liquid, and air impermeable material. This prevents air loss during the air flow from the microclimate inlet port 54 to the side vent 68. In some embodiments, a microclimate inlet port 54 may be on a patient's right side 66 and the side vent 68 may be on a patient's left side 64. Other inlet port and outlet designs may be used.

Once the moisture reaches the middle layer 58, the moisture is carried away from evaporation by air flowing through the middle layer 58 of the disposable incontinence pad 30. As described above, the air from the air box 26 flows laterally across the middle layer 58 from the microclimate inlet port 54 to the side vent 68. Accordingly, the cooled-vapor from evaporation is directed toward the side vent 68 to exit the disposable incontinence pad 30. In addition, because the air box 26 provides pressurized air, the cooled-vapor from evaporation may be pushed upwardly toward the upper layer 56 of the disposable incontinence pad 30. This not only removes the moisture at the top surface 46 of the disposable incontinence pad 30, but also facilitates to cool and dry the patient's skin around the interface of the patient's skin with the top surface 46 of the disposable incontinence pad 30. Further, the pressure from the air box 26 allows the air to maintain its flowpath, thus preventing the moisture from reverse flow into the air box 26.

In case of an incontinent event, liquid permeates through the upper layer 56 into a middle layer 58. To prevent liquid from leaking through the lower layer 60 to the support surface 24 of the mattress 22, the lower layer 60 comprises a liquid impermeable material. In addition, the third conduit 34 connecting the mattress outlet port 52 and the microclimate inlet port 54. The incontinence pad 30 includes a check valve 55 with ball-type shutter near the microclimate inlet port 54, which automatically prevents liquid from overflowing into the air box 26 while providing the air through the microclimate inlet port 54. In other embodiments, other types of check valve may be used. In other embodiments, the check-valve 55 may be omitted.

The microclimate system 36 includes a sensor (not shown) which is in electrical communication with the controller 82. The sensor detects the liquid level in the middle layer 58 of the disposable incontinence pad 30. If the sensor detects the liquid level exceeding a predetermined threshold level, the controller 82 automatically shuts off the air from the air box 26, thereby closing the check valve 55 to prevent liquid from overflowing into the connected conduit. In some embodiments, the check valve 55 is configured so that an excessive level of liquid will cause the check valve 55 to close, preventing flow from the air box 26. The air box 26 detects that the flow is occluded and shuts off the air flow. Subsequent to shutting off the air, the microclimate system 36 activates the indicator to alert caretakers to dispose the current disposable incontinence pad and provide a new disposable incontinence pad. In one embodiment, the LED light on the user interface 38 of the microclimate system 36 is used as an indicator. When the indicator is activated, the LED light on the on the user interface 38, for example, changes from green to red. The disposable incontinence pad 30 can be removed by disassembling the third conduit 34 from the microclimate inlet port 54. When the caretaker replaces the disposable incontinence pad and the controller 82 detects the liquid level not exceeding the predetermined threshold level, the controller 82 deactivates the indicator. When the indicator is deactivated, the LED light on the user interface 38, for example, changes from red to green. The indicator may accompanied by an alert sound. During the changing process, the third conduit 34 may be further disassembled from the mattress outlet port 52, and be cleaned and dried to ensure that the liquid has not overflowed into the third conduit 34.

Figure 7:
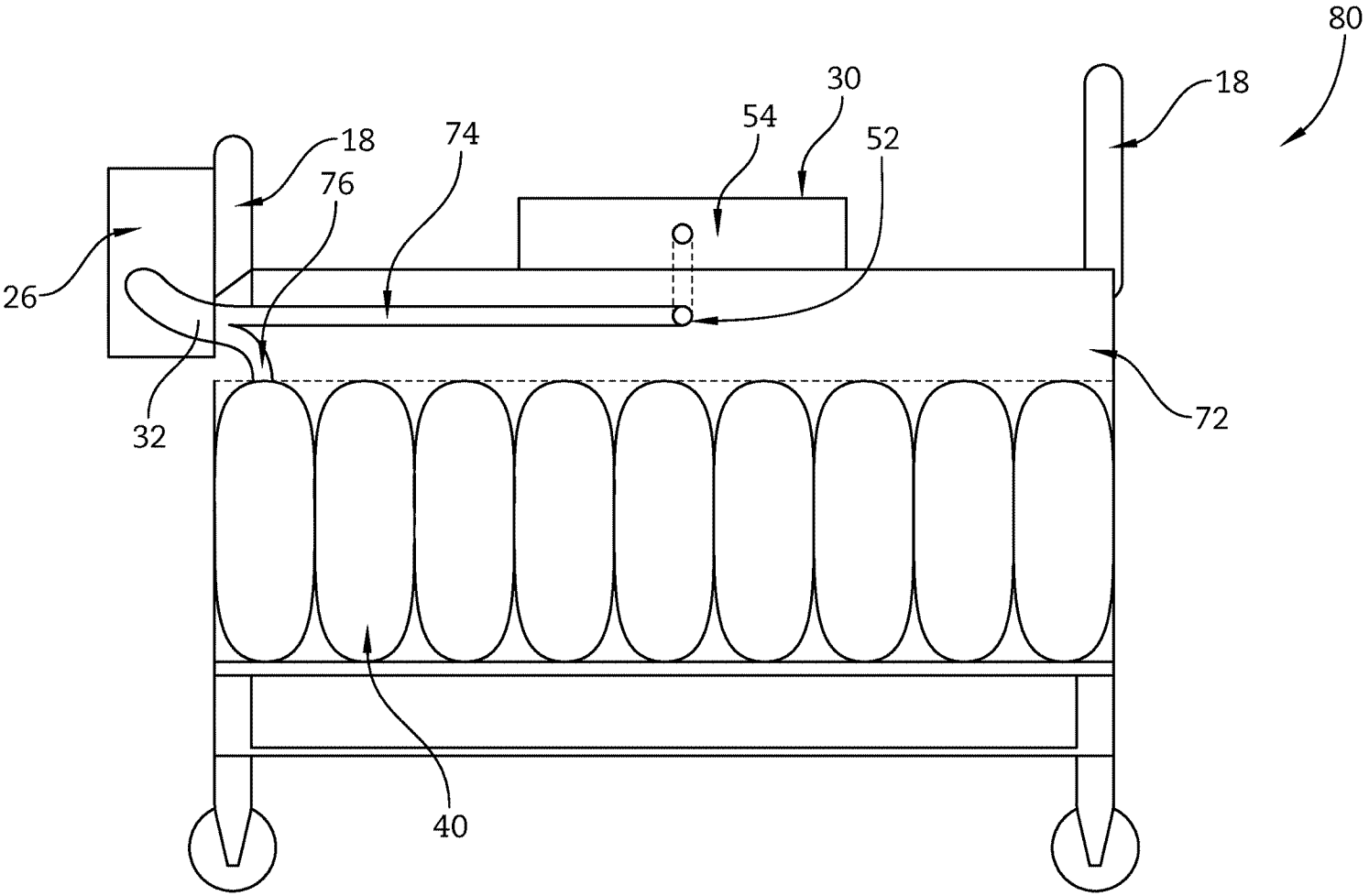
FIG. 7 is a cross section of the patient support structure showing the air box connected to the disposable incontinence pad and inflatable support bladders of the mattress.

In some embodiments, the mattress 22 comprises closed cell foam (not shown). In other embodiments, the mattress 22 comprises one or more inflatable support bladders 40. In yet other embodiments, the mattress 22 may comprise of any combination of foam, polymeric material and/or inflatable support bladders 40. In the illustrative embodiment of the patient support apparatus 80, as shown in FIG. 7, includes the mattress 22 comprising of a foam layer 72 and the inflatable support bladder 40. The foam layer 72 atop the inflatable support bladder 40. The inflatable support bladders 40 require air to support the support surface 24 and the disposable incontinence pad 30 also requires air to cool and dry the interface between the patient 42 and the disposable incontinence pad 30. Accordingly, the air box 26 is connected to the mattress 22 via the first conduit 32. Inside of the foam layer 72 of the mattress 22, the first conduit 32 is divided into two conduits 74, 76. To provide air efficiently to the disposable incontinence pad 30, the one of the two conduits 74 is directly connected to the microclimate inlet port 54 of the disposable incontinence pad 30. The other conduit 76 is connected directly to the inflatable support bladders 40 to provide pressurized air to support the support surface 24 of the patient support apparatus 80.

Figure 8:
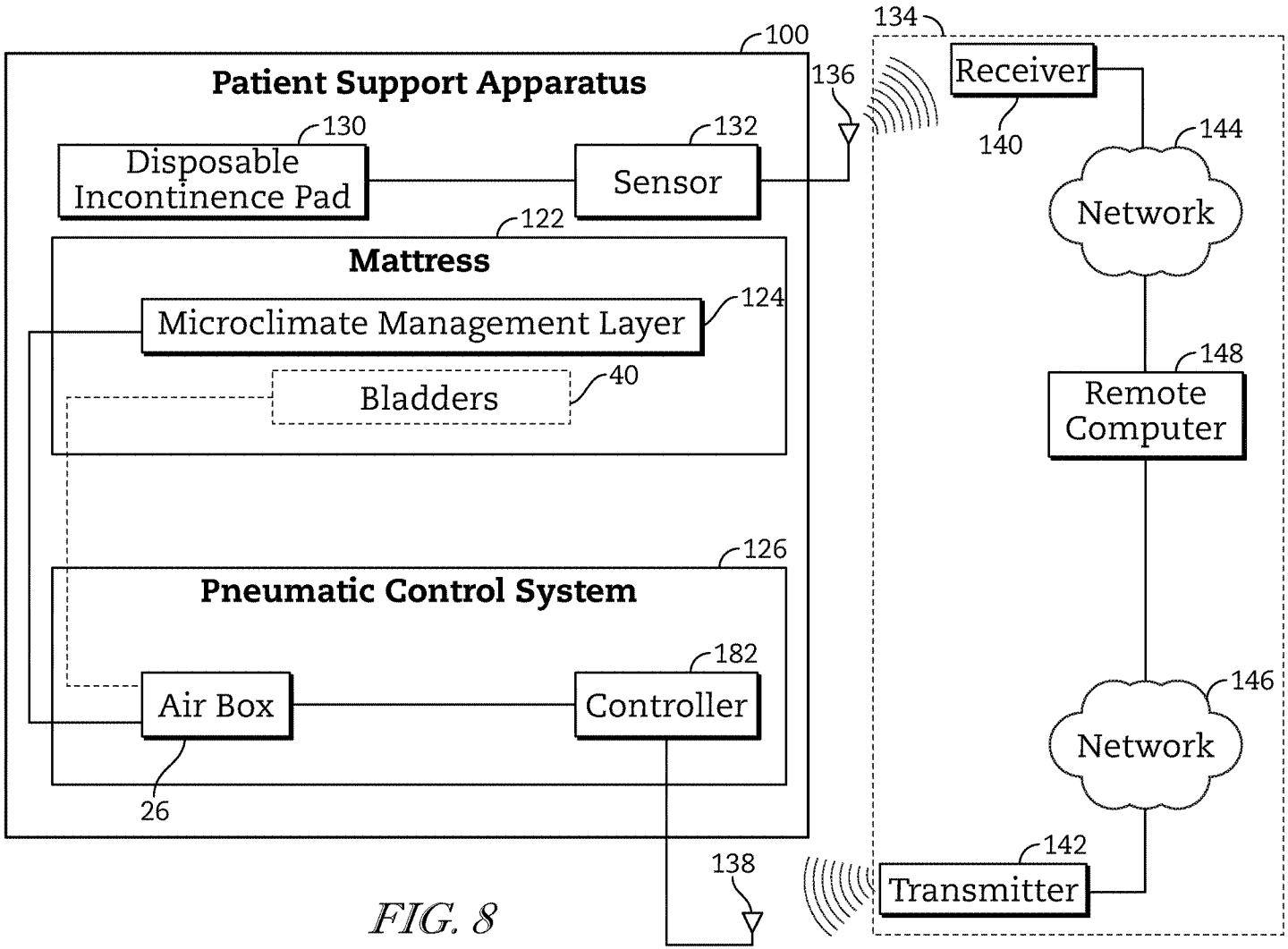
FIG. 8 is a block diagram schematic of a second embodiment of a patient support apparatus.
Figure 9:
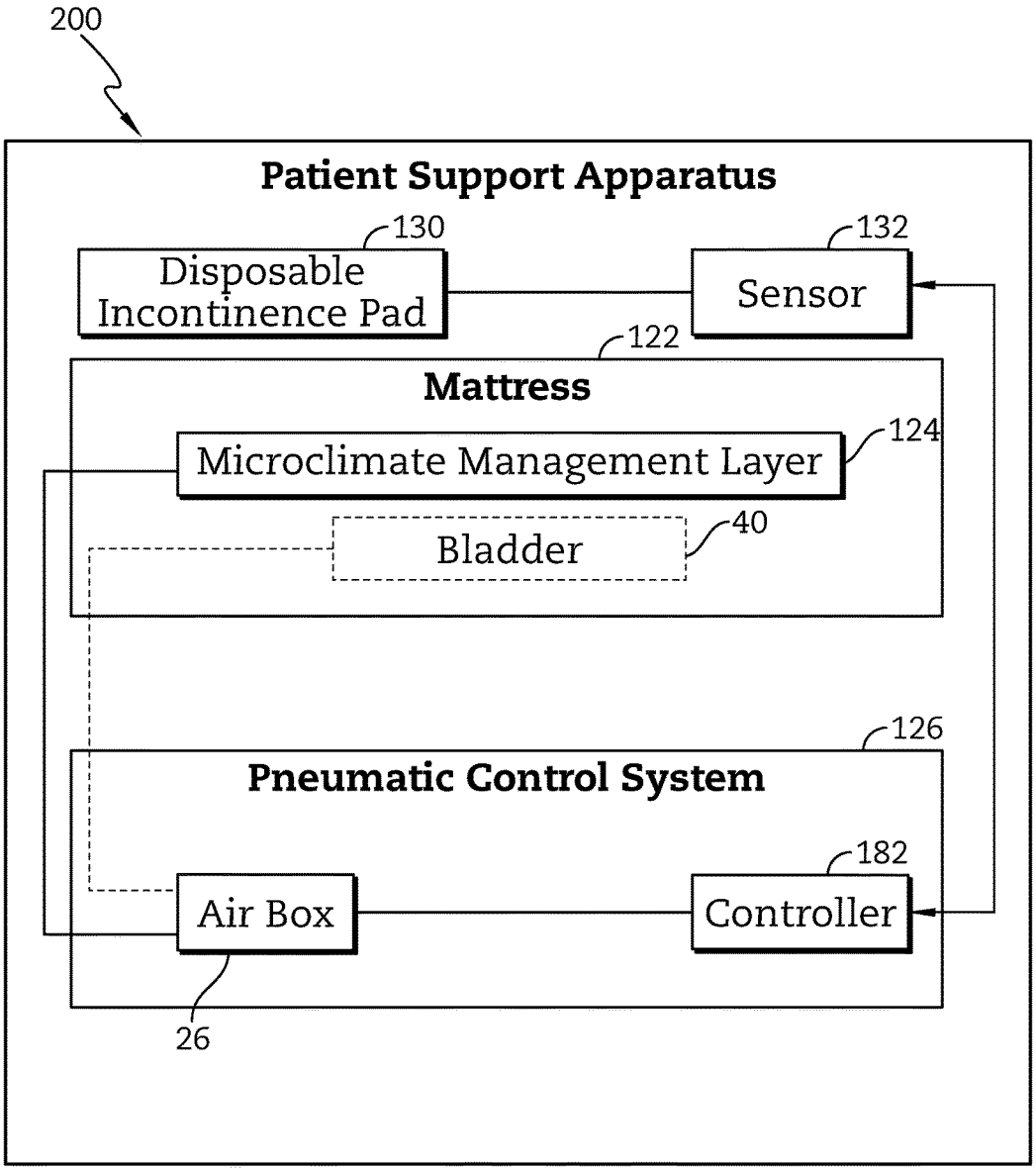
FIG. 9 is a block diagram schematic of a third embodiment of a patient support apparatus.

Referring now to FIGS. 8 and 9, other embodiments of a patient support apparatus are shown in block diagram schematics. The embodiments of FIGS. 8 and 9 include many of the same features described above in regard to FIGS. 1-7. The same reference numbers are used in FIGS. 8 and 9 to identify features that are the same or similar to those described above in regard to FIGS. 1-7. In this embodiment, a disposable incontinence pad 130 is not coupled to the air box 26. Instead, the air box 26 is directly coupled to a microclimate management layer 124 of a mattress 122, as will be discuss in detail below.

As shown in FIG. 8, the patient support apparatus 100 may include the mattress 122, the disposable incontinence pad 130, a sensor 132, and a pneumatic control system 126. The mattress 122 further includes the microclimate management layer 124 and may include a plurality of inflatable support bladders 40. In some embodiments, the mattress 122 may include foam padding. The incontinence pad 130 is supported on top of the mattress 122 and is coupled to the sensor 132. It should be appreciated that in some embodiments, sensor 132 is locating in or on pad 130. As described in greater detail below, the sensor 132 is configured to determine the condition of the disposable incontinence pad 130 by detecting the presence of liquid in the disposable incontinence pad 130 and report the condition of the disposable incontinence pad 130 to the pneumatic control system 126. In one embodiment, the disposable incontinence pad 130 is substantially the same as one or more of those that are shown and described in U.S. Provisional Application No. 62/255,592, filed Nov. 16, 2015, which is hereby incorporated by reference.

The pneumatic control system 126 is configured to cool and dry the interface between the patient 42 and the disposable incontinence pad 130 by adjusting the air to the microclimate management layer 124 to promote patient's skin health. The pneumatic control system 126 includes the air box 26 and a controller 182. The controller 182 of the pneumatic control system 126 is configured to adjust the flow of air from the air box 26 in response to the condition of the disposable incontinence pad 130. The air box 26 is capable of operating at various speeds and is coupled to the microclimate management layer 124 of the mattress 122 to push air toward the surface of the mattress 122. The controller 182 is configured to receive the pad information from the sensor 132 via a remote system 134 to control the air box 26. The controller 182 adjusts the flow of air provided by the air box 26 to the microclimate management layer 124 and may also adjust the temperature of air provided by the air box 26 to the microclimate management layer 124. In some embodiments, the pneumatic control system 126 may further include a graphical user interface (not shown) to receive a user input from a microclimate control displayed on the graphical user interface.

As shown in FIG. 8, the sensor 132 communicates with the pneumatic control system 126 via the remote system 134. The remote system 134 is configured to receive the pad information from the sensor 132 regarding the condition of the disposable incontinence pad 130 and transmit that pad information to the pneumatic control system 126. The remote system 134 includes one or more transceivers that receive and transmit the pad information from and to the patient support apparatus 100 via a network of a healthcare facility. In some embodiments, the pad information may be transmitted via a cellular wireless network. In the illustrated embodiment, the remote system 134 includes a receiver 140, a transmitter 142, networks 144, 146, and a remote computer 148. It should be appreciated that the receiver 140 and the transmitter 142 may be the same transceiver.

The sensor 132 of the patient support apparatus 100 is configured to determine the condition of the disposable incontinence pad 130 and report that condition to a remote system 134 wirelessly through an antenna 136. The receiver 140 of the remote system 134 receives the condition of the disposable incontinence pad 130 and transmits that pad information to the remote computer 148 over the network 144. The remote computer 148 then forwards the condition of the disposable incontinence pad 130 to the transmitter 142 over the network 146. The networks 144, 146 are connected to the patient support apparatus 100 through a wireless data link. In some embodiments, the remote computer 148 may be linked to a hospital information system. In other embodiments, the remote computer 148 may be coupled to a traditional nurse call system such that the alert condition is transmitted to a nurse's station over a traditional nurse call cable in case of an incontinent event.

Subsequently, the transmitter 142 transmits the pad information to the controller 182 of the pneumatic control system 126. The controller 182 receives the pad information through an antenna 138 and is configured to adjust the air box 26 depending on the pad information it receives regarding the disposable incontinence pad 130. It should be appreciated that the networks 144, 146 may be connected to the patient support apparatus 100 through a wired data link. In some embodiments, the remote system 134 may share one network such that the network 144 and the network 146 are one in the same and/or share the same medium.

In the absence of detecting the liquid in the disposable incontinence pad 130, the air box 26 is operating at a low energy consumption mode. During the low energy consumption mode, the air box 26 operates at a slower operating speed to provide air at a lower flow rate to the microclimate management layer 124. Alternatively or additionally, the controller 182 decreases the temperature of the air provided by the air box 26. Providing low airflow at lower temperature to the microclimate management layer 124 facilitates the withdrawal of heat and moisture from the incontinence pad 130. The lower temperature of air removes the heat away from the incontinence pad 130 and the low flow of air constantly moves the air surrounding the incontinence pad 130 to remove the moisture from the incontinence pad 130. It should be appreciated that the slower flow rate of air may be manually entered using the graphical user interface (not shown) depending on the patient's need.

In case of an incontinent event, the sensor 132 detects the presence of liquid in the incontinence pad 130 and determines that the disposable incontinence pad 130 is wet. When the sensor 132 determines that the disposable incontinence pad 130 is wet, the sensor 132 transmits the pad information to the controller 182 to operate the air box 26 at a higher energy consumption mode. At the higher energy consumption mode, the air box 26 operates at a faster operating speed to provide higher airflow and/or higher temperature air to the microclimate management layer 124.

Specifically, the sensor 132 transmits the pad information to the receiver 140 of the remote system 134 through the antenna 136 indicating that the disposable incontinence pad 130 is wet. The receiver 140 then transmits that pad information to the remote computer 148 over the network 144. The pad information may be stored in memory (not shown) and transferred to the hospital information system. In some embodiments, the pad information may be transferred over the network 144 to the hospital information system by the remote computer 148 in real time, or may be stored in memory and transferred to the network 144 on an intermittent basis. In other embodiments, when the pad information is stored on the remote computer 148, the hospital information system may be operable to query the remote computer 148 to receive the most recent pad information stored by remote computer 148 in memory. The remote computer 148 may subsequently transmit that pad information to the transmitter 142 over the network 146. As mentioned previously, in some embodiments, the remote computer 148 may receive and transmit the pad information through the same network.

When the transmitter 142 receives the pad information from the remote computer 148, the transmitter 142 forwards that pad information to the controller 182 of the pneumatic control system 126 of the patient support apparatus 100. In response to receiving the pad information indicating that the disposable incontinence pad 130 is wet, the controller 182 increases the airflow rate from the air box 26 to the microclimate management layer 124. Alternatively or additionally, the controller 182 may increase the temperature of the air from the air box 26 to the microclimate management layer 124. Providing higher airflow at higher temperature to the microclimate management layer 124 facilitates the moisture withdrawal from the incontinence pad 130. Particularly, increasing the temperature of the air to the microclimate management layer 124 provides heated air to the incontinence pad 130. The heated air surrounding the incontinence pad 130 may accelerate the evaporation of liquid in the incontinence pad 130. Further, increasing the airflow rate helps to disperse the air surrounding the incontinence pad 130 to remove the moisture away from the incontinence pad 130. In some embodiments, the lower layer 60 of the disposable incontinence pad 130 may be made of an air permeable material. This may allow the heated air from the microclimate management layer 124 to flow upwardly through the lower layer 60 of the disposable incontinence pad 130 to evaporate the moisture and/or liquid from the disposable incontinence pad 130 to keep the patient's skin dry.

When the sensor 132 subsequently determines that the disposable incontinence pad 130 is dry, the sensor 132 may communicate with the controller 182 via the remote system 134 to revert back to the low energy consumption mode to provide lower airflow at lower temperature to the microclimate management layer 124. This allows the air box 26 to operate at the slower operating speed such that the air box 26 does not consume energy when the higher flow and/or higher temperature of air is not needed. Therefore, the communication between the sensor 132 and the controller 182 regarding the condition of the disposable incontinence pad 130 allows the controller 182 to efficiently and effectively withdraw heat and moisture along an interface between the patient's skin and the disposable incontinence pad 130 to keep the patient's skin dry.

In some embodiments, the sensor 132 may directly communicate with the controller 182 via a wired connection, as shown in FIG. 9. In case of an incontinent event, the sensor 132 detects the presence of liquid in the incontinence pad 130 and transmits the pad information directly to the controller 182 through a wired connection to operate the air box 26 at the higher energy consumption mode. As described above, the higher energy consumption mode provides higher airflow and/or higher temperature air to the microclimate management layer 124 to withdraw moisture along the interface between the patient's skin and the disposable incontinence pad 130. Similarly, when the sensor 132 subsequently determines that the disposable incontinence pad 130 is dry, the sensor 132 directly communicates with the controller 182 via the wired connection to revert back to the low energy consumption mode to provide lower airflow and/or lower temperature air to the microclimate management layer 124 to keep the patient's skin dry.

Air box 26 includes an air source such as a blower, pump, compressor or the like which operates to produce the air flow to mattress 22, mattress 122, and/or pad 30 depending upon the embodiment. Air box 26 also includes associated pneumatic components such as one or more valves, manifolds, conduits, pneumatic connectors, and the like to direct the air flow from the air source to the bladders of mattresses 22, 122 and pad 30 as the case may be. Air box 26 further includes electrical circuitry coupled to user interface 38 and to the valves of air box 26, for example. The electrical circuitry includes one or more sensors such as pressure sensors, flow sensors, rotational speed sensors, and temperature sensors as well as heating elements and cooling elements in some embodiments. Thus, when it is stated that higher airflow or lower airflow is provided by air box 26, it should be appreciated that a speed of a shaft of the air source in air box 26 is adjusted so as to be faster or slower, respectively, than its previous speed. The speed of the shaft of the air source may be controlled based on feedback to the electrical circuitry of air box 26 from one or more of the pressure sensors, flow sensors, and/or rotational sensors, for example, so as to achieve a target pressure or flow rate in a portion of mattress 22, mattress 122 and pad 30, as the case may be.

Although certain illustrative embodiments have been described in detail above, variations and modifications exist within the scope and spirit of this disclosure as described and as defined in the following claims.

The invention claimed is:

1. A patient support structure comprising a mattress having a mattress inlet port and a mattress outlet port, a microclimate system including an air box and a controller, the air box coupled to the controller and coupled to the mattress, and a disposable incontinence pad atop the mattress, the incontinence pad comprising an upper layer being vapor and liquid permeable, a lower layer being liquid impermeable, and a middle layer being air permeable, wherein the middle layer includes a pad inlet port and a side vent at the opposite side of the pad inlet port, wherein the air box is coupled to the mattress, and the mattress outlet port is coupled to the pad inlet port of the disposable incontinence pad to conduct air, wherein the controller of the microclimate system detects the liquid level of the middle layer of the disposable incontinence pad, and wherein the controller automatically shuts off the air from the air box when the liquid level exceeds a predetermined threshold level to prevent liquid from overflowing into the air box, and wherein, subsequent to shutting off the air, the controller activates an indicator to alert caretakers to dispose of the current disposable incontinence pad.

2. The patient support structure of claim 1, wherein the air box is coupled to the mattress via a conduit, the conduit conducts the air from the air box to the mattress.

3. The patient support structure of claim 1, wherein the mattress inlet port is coupled to the air box, and the mattress outlet port is coupled to the disposable incontinence pad.

4. The patient support structure of claim 1, wherein the disposable incontinence pad comprises a check valve positioned to prevent a flow of liquid into the conduit.

5. The patient support structure of claim 1, wherein the disposable incontinence pad is movable along a top surface of the mattress to underlie where the pelvic region of a patient lying supine on the patient support structure.

6. The patient support structure of claim 1, wherein the mattress includes inflatable support bladders.

7. The patient support structure of claim 1, wherein the middle layer of the disposable incontinence pad comprises a three-dimensional material configured to conduct air between the upper layer and the lower layer of the disposable incontinence pad.

8. The patient support structure of claim 2, wherein a conduit connecting the pad inlet port and the mattress outlet port includes a check valve to prevent moisture and liquid from overflowing into the conduit while providing the air to the disposable incontinence pad.

9. The patient support structure of claim 1, wherein the controller activates an indicator to alert caretakers when the liquid level exceeds a predetermined threshold level.

10. The patient support structure of claim 9, wherein the air box is coupled to the mattress via a conduit, the conduit conducts the air from the air box to the mattress.

11. The patient support structure of claim 9, wherein the mattress inlet port is coupled to the air box, and the mattress outlet port is coupled to the disposable incontinence pad.

12. The patient support structure of claim 9, wherein the disposable incontinence pad comprises a check valve positioned to prevent a flow of liquid into the conduit.

13. The patient support structure of claim 9, wherein the disposable incontinence pad is movable along a top surface of the mattress to underlie where the pelvic region of a patient lying supine on the patient support structure.

14. The patient support structure of claim 9, wherein the mattress includes inflatable support bladders.

15. The patient support structure of claim 9, wherein the middle layer of the disposable incontinence pad comprises a three-dimensional material configured to conduct air between the upper layer and the lower layer of the disposable incontinence pad.

16. The patient support structure of claim 15, wherein a conduit connecting the pad inlet port and the mattress outlet port includes a check valve to prevent moisture and liquid from overflowing into the conduit while providing the air to the disposable incontinence pad.

17. The patient support structure of claim 9, wherein a conduit connecting the pad inlet port and the mattress outlet port includes a check valve to prevent moisture and liquid from overflowing into the conduit while providing the air to the disposable incontinence pad.

* * * * *